United States Patent [19]

Traut

[11] 4,187,062

[45] Feb. 5, 1980

[54] BYPASS ROTARY GAS EXPANSION MOTOR

[76] Inventor: Earl W. Traut, 8040 Palm Lake Dr., Orlando, Fla. 32811

[21] Appl. No.: 925,642

[22] Filed: Jul. 17, 1978

[51] Int. Cl.[2] ..... F01C 1/02; F01C 21/12

[52] U.S. Cl. ..... 418/61 B; 418/180; 418/187

[58] Field of Search ..... 418/54, 61 B, 180, 187; 417/204

[56] References Cited

U.S. PATENT DOCUMENTS

| | | | |
|---|---|---|---|
| 302,179 | 7/1884 | Walker | 418/54 |
| 1,277,018 | 8/1918 | Wolfington | 418/61 B |
| 3,301,228 | 1/1967 | Winans | 418/61 B |
| 3,996,901 | 12/1976 | Gale et al. | 418/61 B |
| 4,008,982 | 2/1977 | Traut | 418/61 B |
| 4,101,248 | 7/1978 | Traut | 418/61 B |

*Primary Examiner*—John J. Vrablik

[57] ABSTRACT

A compact, rotary gas-operated motor having only three moving components including valving. Pressurized gas entering through a crank causes it to move within a slot in an elongate rotor which rotates end-over-end within a generally triangular chamber. Pressurized gas bypassed to the space between the rotor and a chamber wall also causes rotation. Expansion ratios of 5:1 to 15:1 or more may readily be obtained.

4 Claims, 3 Drawing Figures

10
11
12
13
13a
13b
13c
14
15
15a
15b
15c
15d
15e
15f
15g
16
17
18
19
19a
20
2

BYPASS ROTARY GAS EXPANSION MOTOR

RELATIONSHIP TO PRIOR INVENTIONS

This invention bears a definite relationship to my U.S. Pat. No. 4,008,982 entitled Rotary Fluid Energy Converter and my U.S. Pat. No. 4,101,248 entitled Rotary Gas Expansion Motor.

BACKGROUND OF THIS INVENTION

1. Field of the Invention

This invention relates to that class of device involving a rotor which rotates within a chamber in continuous contact with its walls, dividing the chamber into two variable volume compartments. Both the rotor and a crank inserted in a block which slides back and forth within a slot in the rotor are acted upon by gases to produce rotation of the shaft; gases being admitted through a hole in the crank and exhausted through a port in a disk adjacent the chamber and rotor. This invention involves novel means of admitting pressurized gas through the crank at regular intervals and bypassing gas from inside the rotor to the chamber; to provide gas expansion ratios from about 5:1 to over 15:1, thereby efficiently utilizing the energy of hot, high pressure gases.

2. Description of Prior Art

Most positive displacement gas-expansion motors in use today, if of the rotary type, require complex rotor seals, valving means and gearing. And their expansion ratio is usually limited by the geometry of the rotor with respect to the chamber and by the valving.

SUMMARY OF THE INVENTION

This invention relates to a rotary, positive displacement, space-effective, gas operated motor in which novel valving means permits gas flow to be cut off during the power strokes of its rotor and crank, thus requiring the hot compressed gases flowing though it to more efficiently expend their energy as they cause mechanical rotation.

For the purpose of this invention, expansion ratio is defined as the maximum volume of a chamber compartment and a slot cell as compared to the volume of gas admitted to a slot cell at the time of inlet gas cut-off.

As an elongate rotor rotates end-over-end inside a generally triangular chamber, a crank oscillates within a slot in the rotor. A disk covering the greater portion of one end of the chamber is coaxially affixed to an output shaft and has a crank affixed to it, the disk thus being adjacent the chamber and the rotor. Two ports in this disk rotate with it and are so shaped and located in it that one of them communicates between one side of the rotor and one side of the sliding block within the rotor at certain times to act as a gas bypass port, while the second port communicates with the other side of the sliding block to act as an exhaust port. During those times when the bypass port does not communicate between a side of the rotor and a side of the sliding block, a hole in the sliding block communicates with the inlet source of pressurized gas through a hole in the crank. In this invention inlet gas enters a rotor slot cell under full pressure for up to half of its travel, gas pressure then being cut off and the gas trapped in this cell being bypassed to one side of the rotor as it begins its travel.

By the time the rotor has traveled halfway through the chamber the sliding block has completed its travel in the slot and the bypass port no longer communicates with either. The gas under the rotor has expanded to about four times its original volume at this point and continues to expand to about 8:1 during the remainder of the rotor movement. Also, during the last half of the rotor movement gas enters the other rotor slot cell via the hole in the crank and a second hole in the sliding block. Varying the width of the rotor with respect to its length and varying the size of the holes in the crank and sliding block can be used as a means of changing the expansion ratio in a range of from about 5:1 to over 15:1.

Accordingly, it is an object of the present invention to provide a positive displacement rotary gas-operated motor into which gases are admitted only during the initial portion of each power stroke; these gases expanding during the remainder of the power stroke.

Another object of the invention is to provide a gas-operated motor in which a hole in a block surrounding its crank communicates with a hole in the crank at certain times, to regulate the times at which pressurized gas is admitted.

It is a further object of the invention to provide a gas-operated motor which accommodates a greater amount of fluid flow for its size than comparable rotary devices including the Wankel engine, thus permitting it to be comparatively small and light in weight.

It is yet another object of the invention to provide a rotary gas expansion motor which has only three moving components including valving, and which requires no gears.

A still further object of the invention is to provide a rotary gas expansion motor in which pressurized gas is automatically bypassed from its rotor slot to a chamber compartment to increase the overall expansion ratio of the charge of pressurized gas.

Still another object of the invention is to provide a rotary gas expansion motor which can readily be designed to operate with a range of expansion ratios of from about 5:1 to over 15:1.

These and other objects, features and advantages will be more apparent from a study of the appended drawings in which.

DETAILED DESCRIPTION

Figures 1, 2, 3:
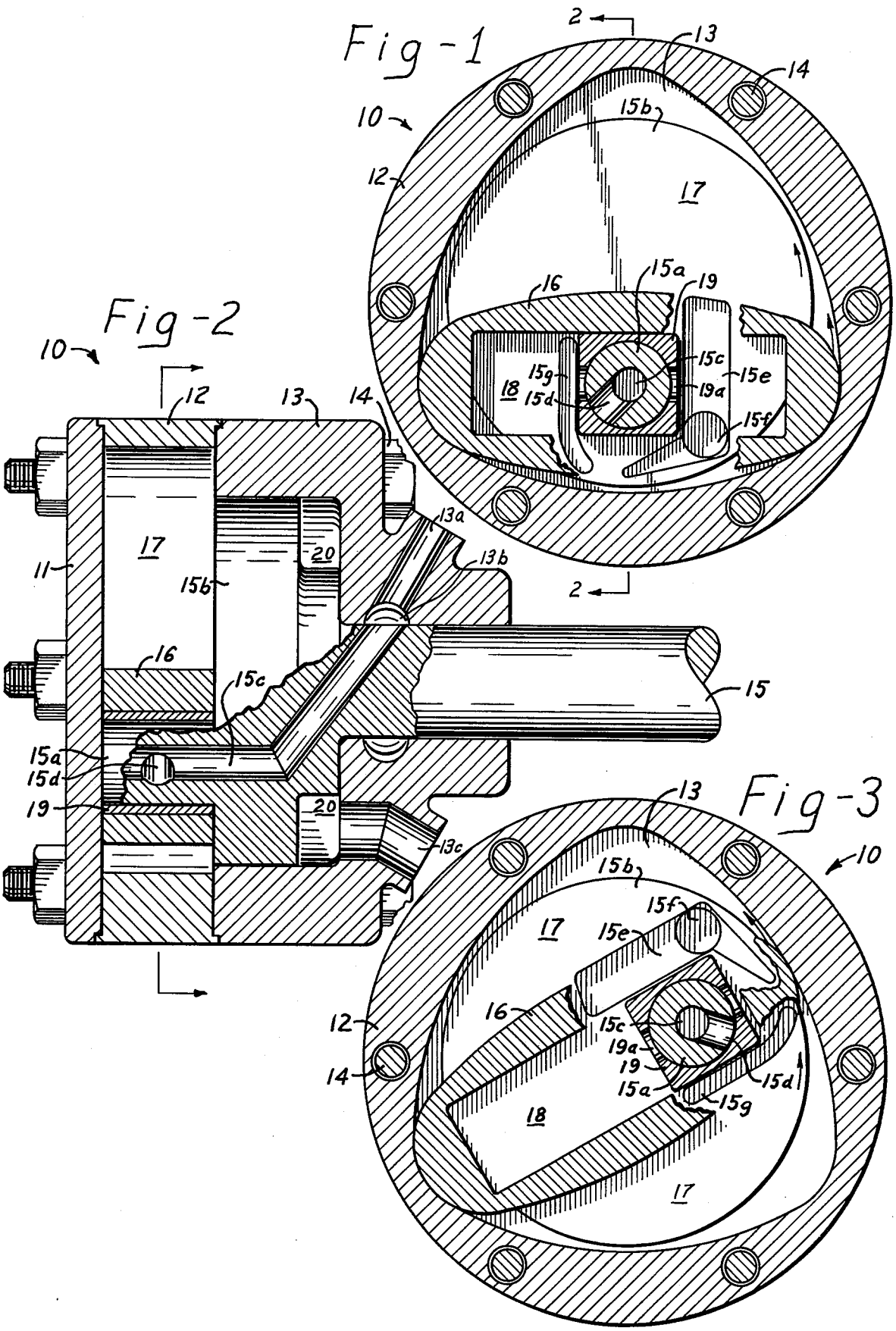
FIG. 1 is a vertical sectional view of a rotary gas expansion motor through its chamber, rotor and crank, with portions of the rotor being broken away to reveal the shape of the bypass port and outlet port.
FIG. 2 is a cross sectional view taken along lines 2—2 of FIG. 1 and looking in the direction of the arrows, a portion of the crank, disk and shaft assembly being broken away to reveal the inlet gas flow path.
FIG. 3 is a cross sectional view similar to that of FIG. 1 showing the position of the components after 30° of rotor rotation and 120° of crank rotation.

Turning now to FIGS. 1–3, there will be seen bypass rotary gas expansion motor 10, in which gas flowing into the slot in an elongate rotor and thence into a generally triangular chamber, causes the rotor to rotate end-over-end in the chamber.

The stationary components of motor 10 are: end housing 11; chamber housing 12, which encloses triangular chamber 17; shaft housing 13 which includes inlet **13*a*, annular opening 13*b* and outlet 13*c*; and six bolts 14** with nuts to fasten the three housings together.

The dynamic components include shaft 15 with its affixed crank **15*a* and disk 15*b*, elongate rotor 16 with its internal elongate slot 18, and sliding block 19 which surrounds crank 15***a* in slot 18. Note that sliding block 19 includes two inlet ports 19*a* which at certain positions during rotation communicate through hole 15*d*, duct 15*c* and annulus 13*b* with inlet 13*a*. Disk 15*b* includes outlet ports 15*e* and hole 15*f* which continually communicate through space 20 with outlet 13. Disk 15*b* also includes bypass port 15*g* which at certain positions during rotation causes the portion of slot 18 on one side of block 19 to communicate with the portion of chamber 17 on one side of rotor 16.

Looking primarily at FIG. 1, it can be seen that inlet ports 19*a* are blocked from hole 15*d*, bypass port 15*g* contacting only the slot 18 cell of the left side of block 19, and outlet port 15*e* communicating only with the slot 18 cell on the right side of block 19. When motor 10 is in operation, rotation being in the direction of the arrows, pressurized gas from the previous cycle is trapped in the slot 18 cell on the left side of block 19, causing it to move to the right and causing the right end of rotor 16 to begin to move upwards. This movement exposes the lower end of bypass 15*g* to the chamber 17 compartment below rotor 16, permitting pressurized gas to flow into it. Also, outlet port 15*e* moves to where it is exposed to the chamber 17 compartment above rotor 16 to exhaust gas therefrom. The right end, rather than the left end, of rotor 16 will rise because gas pressure in the left slot 18 cell will tend to hold the left end of rotor 16 in lower left corner of chamber 17. However, mechanisms such as those disclosed and claimed in my U.S. Pat. No. 3,008,982 may be used to mechanically prevent reverse rotation of rotor 16.

During the first 30° of counterclockwise rotation of rotor 16 and 120° of counterclockwise rotation of crank 15*a* and disk 15*b*, the dynamic components will move from their positions of FIG. 1 to the positions shown in FIG. 3, and gas trapped in the left slot 18 cell and in the chamber 17 compartment under rotor 16 will expand to about four times its original volume. Gas in right slot 18 cell and the chamber 17 compartment above rotor 16 will exhaust through outlet port 15*e*.

When the dynamic components are positioned as shown in FIG. 3, hole 15*d* has not been in communication with either of ports 19*a* but is almost in contact with right port 19*a*. Bypass 15*g* has just completed communicating with the chamber 17 compartment below rotor 16 and is almost in contact with the right slot 18 cell. Outlet port 15*e* has just ceased communication with right slot 18 cell and continues to communicate with the chamber 17 compartment above rotor 16.

During a further 30° of counterclockwise rotation of rotor 16: gas trapped in the chamber 17 compartment below rotor 16 expands at about a 2:1 ratio, pressurized gas enters right slot 18 cell through right port 19*a*, bypass 15*g* communicates only with right slot 18 cell, and gas in left slot 18 cell and in the chamber 18 compartment above rotor 16 exhausts through outlet port 15*e*.

After this second 30° of rotation, rotor 16 will be adjacent the left wall of chamber 17 and all dynamic components will have the same relative postion with respect to the left chamber wall that they originally had to the bottom wall of chamber 17 in FIG. 1.

Thus, after a total of 60° rotation of rotor 16 and 240° rotation of shaft 15 there has been a complete power stroke, or movement, by rotor 16; and the last and first halves respectively of power strokes by block 19 in slot 18. So, 720°, or two complete revolutions of shaft 15, will result in three power strokes by rotor 16 and three power strokes by block 19.

It should be noted that the geometric proportions of rotor slot 18 and chamber 17 of motor 10 result in an overall expansion ratio of about 8:1. Decreasing the height of rotor 16 in FIG. 1 would increase the expansion ratio since the left slot cell would initially hold a smaller pressurized gas charge and the chamber would be larger in volume. Similarly, increasing the height of rotor 16 would decrease the expansion ratio; a range of about 5:1 to 10:1 being readily obtainable.

Note also in FIG. 1, that bypass 15*g* does not communicate between left slot 18 cell and the chamber 17 compartment below rotor 16 until inlet gases are cut off from left inlet port 19*a*. Hole 15*d* or ports 19*a* can be increased in size to extend the period during which gas enters left slot 18 cell, thus to permit gas at inlet pressure to pass through bypass 15*g* into the chamber 17 compartment below rotor 16, but this reduces the overall expansion ratio. Conversely, reducing the size of hole 15*d* or ports 19*a* can increase the expansion ratio to 15:1 or higher since less inlet gas would be admitted to left slot 18 cell.

The foregoing discussion has assumed that motor 10 is in operation. It should be noted that if motor 10 is stopped in the position of FIG. 1 or FIG. 3 or in positions inbetween, ports 19*a* are blocked from hole 15*d*, gas entering inlet 13*a* thus being unable to act upon rotor 16 or block 19 to initiate rotation. One way to overcome this is to use two or more separate chambers and rotors which utilize interconnected cranks and operate out of phase with each other, so that there is always pressurized gas access to at least one of the dynamic components, as in FIGS. 5–7 of my U.S. Pat. No. 4,008,982.

It should be noted that the action of crank 15*a* in rotor slot 18 is such that rotor 16 gradually accelerates from a position at rest adjacent a chamber wall to a maximum velocity when halfway through its travel, as in FIG. 3, and then gradually decelerates as it approaches the next chamber wall. Also, there is always a positive mechanical relationship between the position of crank 15*a* and rotor 16, this being obtained without the use of gears.

Although sealing means are not shown in FIGS. 1–3, seals would be desireable in most applications and could be similar to those illustrated in my U.S. Pat. No. 4,008,982. Since rotor 16 is always perpendicular to the chamber wall it contacts, one, two or even three linear sealing strips may readily be used at each end of the rotor. FIG. 1A of my U.S. Pat. No. 4,202,248 shows two sealing strips positioned at a rotor end.

I claim:

1. A rotary gas expansion motor comprising:

a generally triangular chamber, an elongate rotor, said rotor being rotatable end-over-end inside said chamber and serving to divide same into two compartments, a shaft with crank, a sliding block, said sliding block surrounding said crank and being rotatable thereupon, said crank and said block extending into a slot in said rotor and serving to divide said slot into two cells, said crank including a hole which communicates with a gas inlet in said motor and with a hole in said block during part of the rotation of said block, to admit gas to one of said slot cells as same is increasing in size, a disk, said disk being coaxially affixed to said shaft adjacent said chamber and said rotor, said disk including a bypass port, said bypass port communicating with one said slot cell and one said chamber compartment when both are increasing in size, exhaust means, so as to cause charges of pressurized gas entering said motor to expand against said block and said rotor before being exhausted.

2. The rotary gas expansion motor as claimed in claim 1 in which said exhaust means comprises at least one exhaust port in said disk, said exhaust port communicating with said slot cells and said chamber compartments whenever same are decreasing in size.

3. The rotary gas expansion motor as claimed in claim 1 in which said hole in said block is positioned to admit pressurized gas to one said slot cell only when same is not in communication with a said chamber compartment via said bypass port.

4. The rotary gas expansion motor as claimed in claim 1 in which said hole in said block is positioned to admit pressurized gas to one said slot cell and through said bypass port to said chamber compartment.

* * * * *